US006639339B1

(12) United States Patent
Bernstein

(10) Patent No.: US 6,639,339 B1
(45) Date of Patent: Oct. 28, 2003

(54) CAPACITIVE ULTRASOUND TRANSDUCER

(75) Inventor: Jonathan J. Bernstein, Medfield, MA (US)

(73) Assignee: The Charles Stark Draper Laboratory, Inc., Cambridge, MA (US)

( * ) Notice: Subject to any disclaimer, the term of this patent is extended or adjusted under 35 U.S.C. 154(b) by 0 days.

(21) Appl. No.: 09/569,080

(22) Filed: May 11, 2000

(51) Int. Cl.[7] ..... H04R 17/00
(52) U.S. Cl. ..... 310/311; 367/181
(58) Field of Search ..... 310/311, 324, 310/348, 365, 366; 367/140, 181

(56) References Cited

U.S. PATENT DOCUMENTS 3,872,332 A * 3/1975 Butter ..... 310/334
6,262,946 B1 * 7/2001 Khuri-Yakub et al. ..... 367/181
6,295,247 B1 * 9/2001 Khuri-Yakub et al. ..... 367/140
6,493,288 B2 * 12/2002 Khuri-Yakub et al. ..... 367/181

FOREIGN PATENT DOCUMENTS

DE 19922967 A1 * 12/2000 ..... B06B/1/02

* cited by examiner

*Primary Examiner*—Thomas M. Dougherty
(74) *Attorney, Agent, or Firm*—Iandiorio & Teska

(57) ABSTRACT

A capacitive ultrasound transducer including a dielectric diaphragm with an electrode; a porous layer; and a spacer structure between the diaphragm and porous layer for defining a capacitive gap between them; the pores of the porous layer providing a compliant reservoir for the fluid in the gap.

29 Claims, 3 Drawing Sheets

CAPACITIVE ULTRASOUND TRANSDUCER

FIELD OF THE INVENTION

This invention relates to a capacitive ultrasound transducer, and more particularly to such a transducer with a porous layer and additionally to such a transducer with a doped conductor region electrode.

BACKGROUND OF THE INVENTION

The best ultrasonic transducers for use in air are capacitive transducers, due to the low mass of the diaphragm actuator and efficient coupling of energy between acoustic and electrical forms. Former capacitive ultrasonic transducers are inefficient because they use a grooved backplate covered by a continuous metallized polymer diaphragm. This structure has high stray capacitance, and suffers from a large transducer gap in the center of the diaphragm where motion is the greatest, necessitating high voltages for actuation. Former transducers were highly resonant (narrow bandwidth) and cannot reproduce spread-spectrum signals such as short pulse signals, chirp signals or pseudo-random noise.

In one prior art approach an attempt was made to increase sensitivity by providing a separate reservoir connected to the gap by capillaries which permitted oil to move between the gap and reservoir in response to motion of the diaphragm. However, the relatively large reservoir and capillaries did not lend themselves to good high frequency performance. In addition the number and size of capillaries required for good sensitivity at high frequencies was practically unobtainable.

BRIEF SUMMARY OF THE INVENTION

It is therefore an object of this invention to provide an improved capacitive ultrasound transducer.

It is a further object of this invention to provide such an improved capacitive ultrasound transducer which is more efficient.

It is a further object of this invention to provide such an improved capacitive ultrasound transducer which has more sensitivity as a receiver and greater output as a transmitter.

It is a further object of this invention to provide such an improved capacitive ultrasound transducer which operates on lower voltage.

It is a further object of this invention to provide such an improved capacitive ultrasound transducer which has broader bandwidth and can transmit and receive short pulse signals, chirp signals, and pseudo-random noise.

It is a further object of this invention to provide such an improved capacitive ultrasound transducer which employs an electrode formed as a conductive region in the diaphragm.

The invention results from the realization that an improved, more efficient, broader bandwidth capacitive ultrasound transducer which operates on lower voltage can be achieved by using a porous layer so that the gap between the porous layer and diaphragm is small and necessitates only a small operating voltage but the total fluid in the gap and in the porous layer is of much larger volume, as if the gap were much larger and provides a greater compliance resulting in a higher sensitivity at lower voltage, and the increased resistance to fluid movement afforded by the porous reservoir broadens the bandwidth of the transducer. Further benefits are realized from employing an electrode formed by a conductive region on the diaphragm.

This invention features a capacitive ultrasound transducer comprising a dielectric diaphragm with an electrode and a porous layer. A spacer structure between the diaphragm and porous layer defines a capacitive gap between them. The pores of the porous layer provide a compliant reservoir for the fluid in the gap.

In a preferred embodiment, the porous layer may include continuously connected porosity and it may be disposed on a support substrate. The support substrate may be silicon. The porous layer may include porous silicon or metal, for example from the group including aluminum, tin, nickel, titanium, stainless steel, brass, bronze, copper and zinc. The diaphragm may include silicon nitride, silicon oxide, Mylar, Kapton, or polysilicon. The spacer structure may be formed integrally with the porous layer. The electrode may include a metallized contact on the diaphragm or may include a doped conductive region on the diaphragm. The diaphragm may be made of polysilicon and the doped region may include silicon and a dopant from the group of boron, phosphorous, arsenic, antimony and aluminum. The porous layer may have a pore volume fraction, between 20% and 80%. The size of the pores may be not greater than the width of the capacitive gap. The capacitive gap may be between 0.1 and 200 microns. The spacer structure may be a dielectric and may be made integral with the porous layer or may be a discrete structure. The porous reservoir may be capable of absorbing substantially all of the volume of fluid in the gap. The gap may contain air or dielectric oil. The porous layer may be conductive.

The invention also features a capacitive ultrasound transducer including a semi-insulating diaphragm including a doped conductive region forming an electrode and a second layer. There is a spacer structure between the diaphragm and the second layer for defining a capacitive gap between them. The semi-insulating diaphragm may include one of a group including polysilicon and silicon carbide. The doped conductor region may include a dopant from the group of boron, phosphorous, arsenic, antimony and aluminum.

BRIEF DESCRIPTION OF THE DRAWINGS

Other objects, features and advantages will occur to those skilled in the art from the following description of a preferred embodiment and the accompanying drawings, in which.

PREFERRED EMBODIMENT

Figure 1:
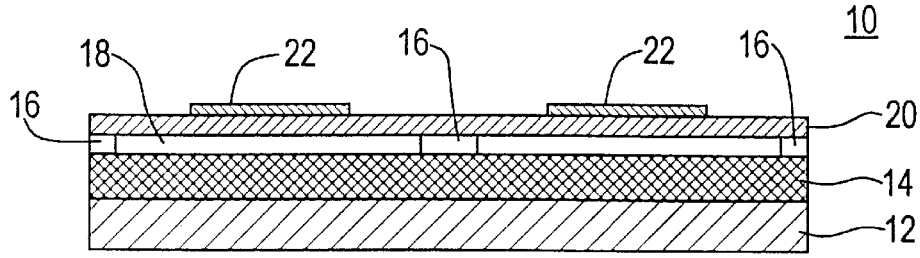
FIG. 1 is a side elevational sectional schematic view of a capacitive ultrasound transducer according to this invention.
Figure 2:
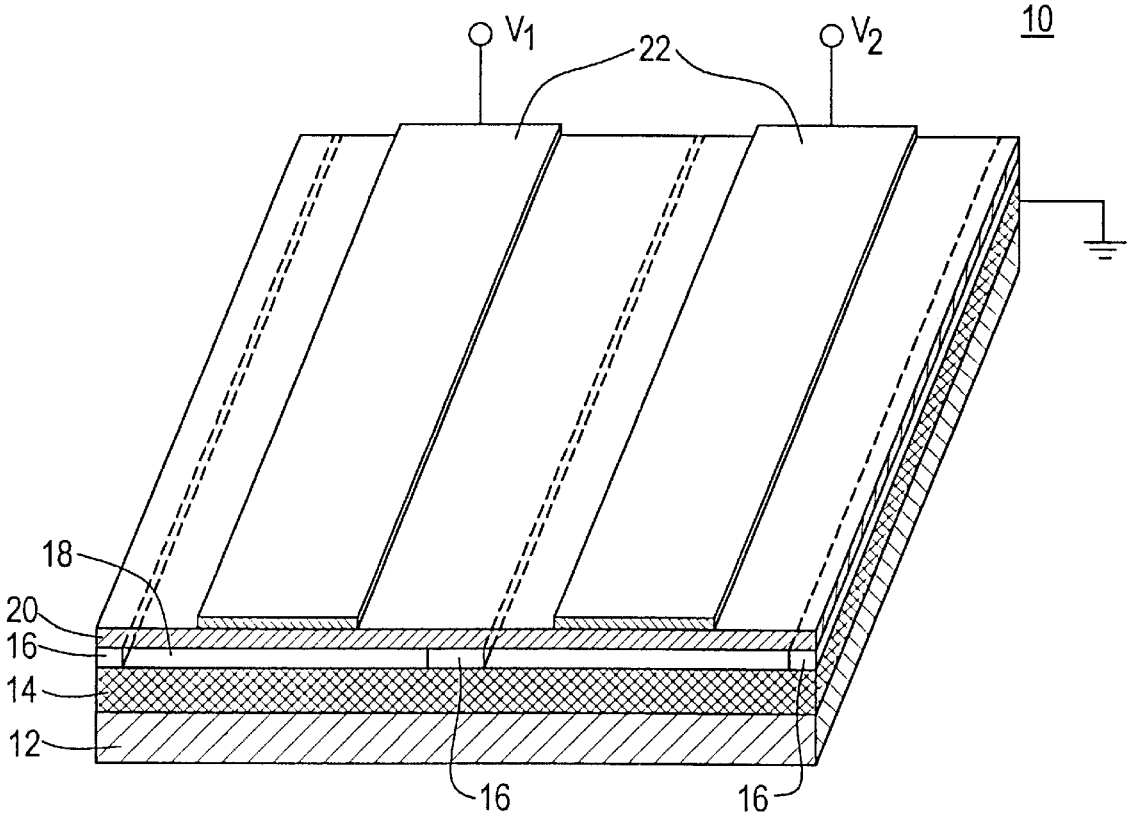
FIG. 2 is a three dimensional view of the transducer of FIG. 1.

There is shown in FIGS. 1 and 2 a capacitive ultrasound transducer 10 according to this invention including a support substrate 12 on which is located a porous backplane, conductor layer 14. Mounted on porous backplane conductive layer 14 is a spacer structure 16 which creates a gap 18 between porous conductor layer 14 and dielectric diaphragm 20. One or more metal electrodes 22 are disposed on diaphragm 20. Porous conductor layer 14 functions as the other electrode. Support substrate 12 may be made of silicon while porous conductor layer 14 may be made of porous silicon or a porous metal such as formed by sintering. The spacer structure 16 may be formed of an oxide or other insulating material. Gap 18 typically has a width somewhere between 0.1 and 200 microns. Typically when the gap is filled with air the range is from 10 to 200 microns and when it is used for underwater acoustic imaging or similar applications it may be from 0.1 to 10 microns. The gap may be sealed so that the fluid in it, such as air or dielectric oil, is isolated from the surrounding atmosphere, or the diaphragm may have a hole in it so that the gap communicates with the surrounding atmosphere.

Conductor layer 14 typically has continuously connected porosity so that it acts as a reservoir to accept the fluid when diaphragm 20 flexes. Diaphragm 20 may be made of silicon oxide, silicon nitride, Mylar, Kapton, or a polysilicon material. The porous conductor may be made of any number of metals including aluminum, tin, nickel, titanium, stainless steel, brass, bronze, copper or zinc. The spacer structure may be formed integrally with the conductor layer or may be a separate structure. Electrodes 22 are typically formed by a metallized contact. The conductor layer may have a pore volume fraction, between 20 and 80% and the size of the pores may be no greater than the width of the capacitive gap which can be between 0.1 and 200 microns but this is not a limitation of the invention. The spacer structure may be a dielectric such as an oxide and the fluid in the gap may be, for example, air or a dielectric oil such as silicone oil. Diaphragm 20 can be formed by applying a metallized diaphragm such as Mylar or Kapton over a porous conductive layer 14 formed from, for example, sintered metal sheets such as are commercially used for filtering. This embodiment is well suited for large area devices such as an acoustic spotlight which sends a narrow beam of sound by nonlinear air mixing.

The porous structure of the conductor layer permits the electrodes to be close together and the gap to be small so that there is only a small operating voltage required. Yet, because the porous layer has a capacity to hold fluid in addition to the fluid present in the gap, there is a larger overall volume of fluid present as if the gap was much larger. The additional fluid provides a greater compliance resulting in a higher sensitivity at lower voltage. Further, the increased resistance to fluid movement afforded by the porous reservoir broadens the bandwidth of the transducer.

Figure 3:
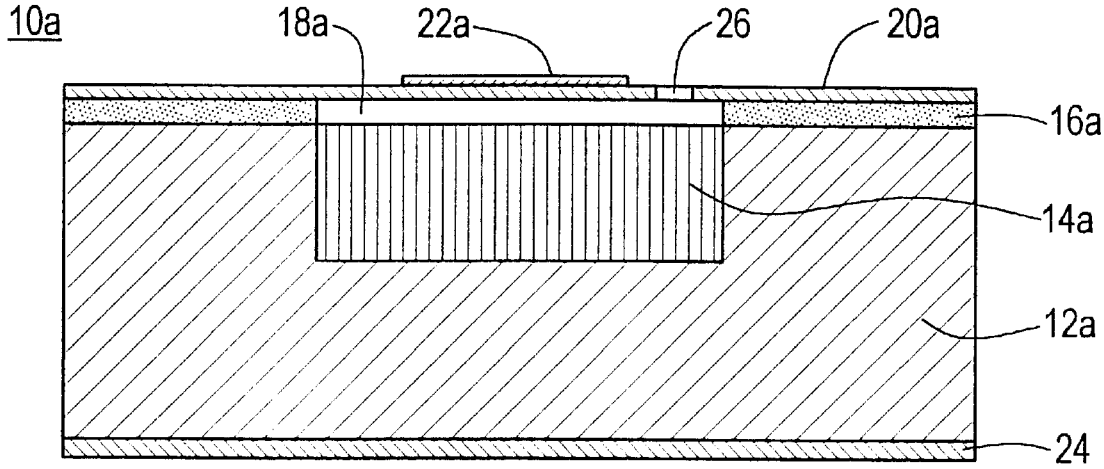
FIG. 3 is a view similar to FIG. 1 of another embodiment of a transducer according to this invention micromachined on a silicon chip with an integral porous conductor layer.

In another embodiment as shown in FIG. 3, where like parts have been given like numbers accompanied by a lower case letter, a region of porous silicon 14*a* again is used as the backplane and the air in the pores adds compliance bringing in the resonant frequency to the desired range. Here the device is fabricated with integral porous silicon for the backplane. The porous silicon is typically formed by anodically etching silicon in fluoride containing solutions. In this embodiment an additional electrode 24 is disposed on the bottom of substrate 12*a* to facilitate electrical connection to the porous backplane.

Gap 18*a*, FIG. 3, has a vent hole 26 so that the gap communicates with the surrounding atmosphere as opposed to the structures shown in FIGS. 1 and 2 where there is no such hole and the gap is isolated from the surrounding atmosphere.

Figure 4:
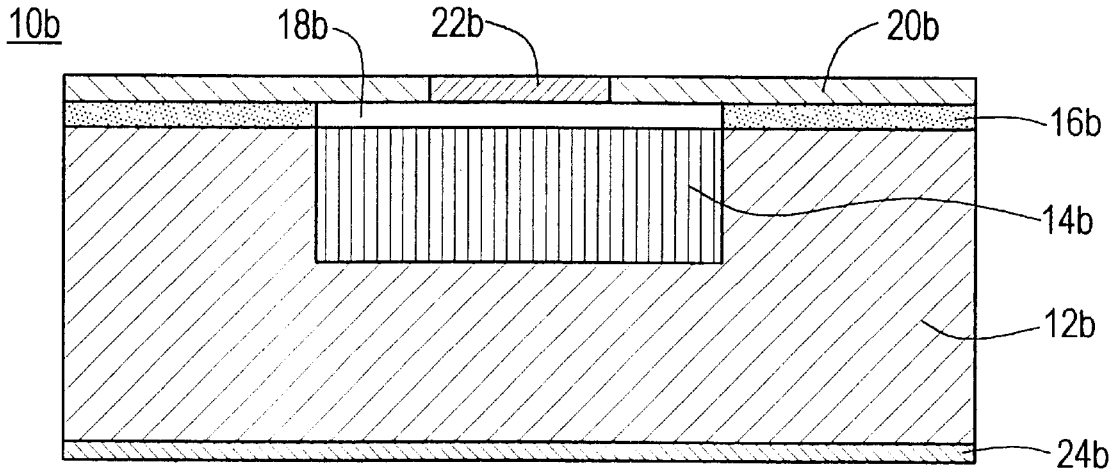
FIG. 4 is a view similar to FIG. 1 of another embodiment of this invention illustrating an electrode formed by a doped conductive region on the diaphragm.
Figure 5:
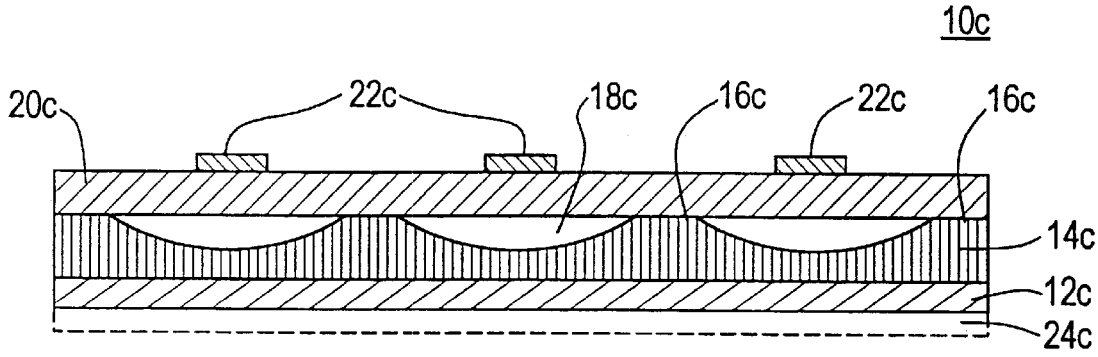
FIGS. 5 and 6 are views similar to FIG. 1 of alternative construction of the transducer according to this invention with integral spacer structure and conductor layer.
Figure 6:
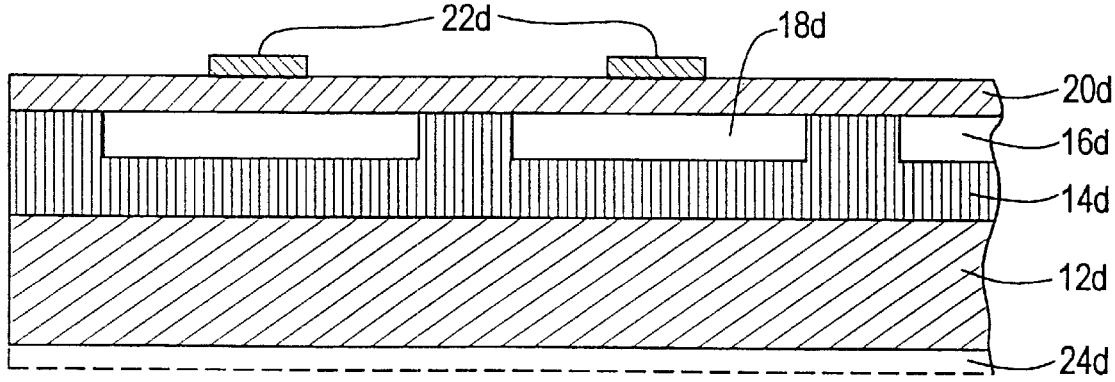

This invention also contemplates the use of a diaphragm 20*b*, FIG. 4, which includes a doped conductive region 22*b* instead of a discrete electrode as shown in FIGS. 1, 2 and 3. Here the doped diaphragm 20*b* may be an undoped semi-insulating polysilicon material whereas region 22*b* is doped with a dopant from the group of boron, phosphorous, arsenic, antimony and aluminum. The remainder of the transducer 10*b* can be constructed similar to the transducer shown in FIG. 3 or the transducer shown in FIGS. 1 and 2. Although the spacer structures in FIGS. 1–4 have been shown as discrete elements, this is not a necessary limitation of the invention. For example, the spacer structure 16*c*, 16*d*, FIGS. 5 and 6, respectively, can be made integral with for example the porous layer 14*c*, 14*d*, respectively. As before, porous layer 14*c*, 14*d* can be conductive or a doped semiconductor and a separate electrode 24*c*, 24*d* may be provided to facilitate electrical connection to the porous backplane.

Although specific features of the invention are shown in some drawings and not in others, this is for convenience only as each feature may be combined with any or all of the other features in accordance with the invention. The words "including", "comprising", "having", and "with" as used herein are to be interpreted broadly and comprehensively and are not limited to any physical interconnection. Moreover, any embodiments disclosed in the subject application are not to be taken as the only possible embodiments.

Other embodiments will occur to those skilled in the art and are within the following claims:

What is claimed is:

1. A capacitive ultrasound transducer comprising: a dielectric diaphragm with an electrode; a porous layer; and a spacer structure between said diaphragm and porous layer for defining a capacitive gap between them; the pores of said porous layer providing a compliant reservoir for the fluid in the gap.

2. The transducer of claim 1 in which said porous layer includes continuously connected porosity.

3. The transducer of claim 1 in which said porous layer is disposed on a support substrate.

4. The transducer of claim 1 in which said porous layer includes porous silicon.

5. The transducer of claim 1 in which said diaphragm includes silicon nitride.

6. The transducer of claim 1 in which said diaphragm includes Mylar.

7. The transducer of claim 1 in which said diaphragm includes Kapton.

8. The transducer of claim 1 in which said diaphragm includes polysilicon.

9. The transducer of claim 1 in which said porous layer includes a porous metal.

10. The transducer of claim 9 in which said porous layer includes one of a group including aluminum, tin, nickel, titanium, stainless steel, brass, bronze, copper and zinc.

11. The transducer of claim 3 in which said support substrate includes silicon.

12. The transducer of claim 1 in which said spacer structure is formed integrally with said porous layer.

13. The transducer of claim 1 in which said electrode includes a metallized contact on said diaphragm.

14. The transducer of claim 1 in which said electrode includes a doped conductive region in said diaphragm.

15. The transducer of claim 14 in which said diaphragm is polysilicon and said doped region includes silicon and a dopant from the group of boron, phosphorous, arsenic, antimony and aluminum.

16. The transducer of claim 1 in which said porous layer pore volume fraction is between 20%–80%.

17. The transducer of claim 1 in which said porous layer pore size is not greater than the width of said capacitive gap.

18. The transducer of claim 1 in which said capacitive gap is between 0.1–200 $\mu$m.

19. The transducer of claim 1 in which said spacer structure is a dielectric.

20. The transducer of claim 1 in which the porous reservoir is capable of absorbing substantially all of the volume of fluid in said gap.

21. The transducer of claim 1 in which said gap contains air.

22. The transducer of claim 1 in which said gap contains dielectric oil.

23. The transducer of claim 1 in which said porous layer is conductive.

24. The transducer of claim 1 in which said diaphragm includes silicon oxide.

25. A capacitive ultrasound transducer comprising: a semi-insulating diaphragm having a doped conductive region forming an electrode; a second layer; and a spacer structure between said diaphragm and second layer for defining a capacitive gap between them.

26. The capacitive ultrasound transducer of claim 25 in which said semi-insulating diaphragm includes one of the group including polysilicon and silicon carbide.

27. The capacitive ultrasound transducer of claim 25 in which said doped conductive region includes a dopant from the group of boron, phosphorous, arsenic, antimony and aluminum.

28. The capacitive ultrasound transducer of claim 25 in which said second layer is a conductor layer.

29. The capacitive ultrasound transducer of claim 25 in which said second layer is a porous layer.

* * * * *